United States Patent [19]

Ivanov et al.

[11] 4,279,742

[45] Jul. 21, 1981

[54] METHOD OF AND APPARATUS FOR THE FLOTATION OF MINERAL RAW MATERIALS

[75] Inventors: Rumen V. Ivanov; Dobrin V. Nikolov, both of Sofia, Bulgaria; Ulrich Bilsing, Freiberg, German Democratic Rep.; Heinz Weber, Freiberg, German Democratic Rep.; Manfred Schmidt, Freiberg, German Democratic Rep.

[73] Assignee: Institute po Physikochimia, Sofia, Bulgaria

[21] Appl. No.: 962,045

[22] Filed: Nov. 20, 1978

Related U.S. Application Data

[63] Continuation-in-part of Ser. No. 862,450, Dec. 20, 1977, abandoned.

[30] Foreign Application Priority Data

Dec. 20, 1976 [BG] Bulgaria ..... 36788
Dec. 20, 1976 [DD] German Democratic Rep. ... 196473

[51] Int. Cl.[3] ..... B03D 1/02

[52] U.S. Cl. ..... 209/166; 209/169; 210/221.1

[58] Field of Search ..... 209/168–170, 209/1, 164, 166; 210/44, 221; 261/82, 81, 93

[56] References Cited

U.S. PATENT DOCUMENTS

| | | | |
|---|---|---|---|
| 1,908,033 | 5/1933 | Liva | 209/168 X |
| 2,766,881 | 10/1956 | Westervelt | 209/109 X |
| 3,722,836 | 3/1973 | Savage | 261/124 X |
| 3,735,868 | 5/1973 | Fedotov | 209/169 |
| 3,785,490 | 1/1974 | Ryan | 210/221 R |
| 3,834,529 | 9/1974 | Hart | 209/166 X |
| 4,075,089 | 2/1978 | Saari | 209/169 |
| 4,133,746 | 1/1979 | Dopson | 209/164 X |

FOREIGN PATENT DOCUMENTS

| | | | |
|---|---|---|---|
| 392240 | 3/1924 | Fed. Rep. of Germany | 209/168 |
| 595613 | 4/1934 | Fed. Rep. of Germany | 209/169 |
| 1353878 | 1/1964 | France | 209/169 |
| 442841 | 10/1974 | U.S.S.R. | 209/169 |
| 451466 | 3/1975 | U.S.S.R. | 210/221 |
| 483142 | 12/1975 | U.S.S.R. | 209/169 |

*Primary Examiner*—Robert Halper

[57] ABSTRACT

A method of and apparatus for the flotation of mineral feedstock using the method of froth flotation. The method may be employed with flotation machines having their own air suction, or with flotation machines with subaeration. Pulps pretreated with flotation agents and having a density up to twice the normal density of ore pulps are submitted to a flotation process with a pulsed air flow by means of normal air supply periods alternating with periods wherein the quantity of air ranges from 1–90% of the normal air supply. The apparatus for carrying out said method makes use of known flotation machines with rotor-stator systems, which machines are modified to provide them with an air duct incorporating an air flow regulating member connected to an appropriate control means. With the existing methods of flotation there are obtained about 400 gr/l of solids in the pulp. With the present method with pulsing air supply there can be obtained about 800 gr/l of solids in the pulp.

10 Claims, 3 Drawing Figures

METHOD OF AND APPARATUS FOR THE FLOTATION OF MINERAL RAW MATERIALS

This application is a continuation-in-part of application Ser. No. 862,450, filed Dec. 20, 1977, now abandoned.

This invention relates to a method of and an apparatus for the flotation of mineral raw materials.

There are well-known methods of froth flotation with inherent suction or with an additional outside air charging means, wherein the quantity of the air supply is kept constant during the flotation process. The flotation method and apparatus during the whole flotation process are based upon a three-phase system, i.e., solid liquid, and gaseous states.

The disadvantages of the known flotation methods with constant air supply are as follows: First, there is a low pulp density (only up to 30–40% of solids); second, there is an insufficient flotation of large particles; third, there is a large energy consumption per ton of treated ore and a high rate of capital investment per ton of treated ore.

There are known flotation machines carrying out the conventional methods of froth flotation of ores which comprise a bath with a rotor-stator system located therein, tail boards and chutes to collect the froth-like product, pulp level controllers, air ducts or pipelines for the suction or charging of air, a rotor drive and skimmers. One such rotor-stator system for use in flotation processes and machines is disclosed in the Green U.S. Pat. No. 3,882,016, May 1975.

Among the drawbacks of the known machines for froth flotation are the following: There is no possibility of operation of the froth flotation machines with higher pulp densities due to the stratification of the solid phase on the bottom of the machine as a result of the impaired circulation of the pulp during the supplying of constant amounts of air to the cells either with inherent suction or by subaeration, and again, there is an insufficient productivity of the machines with respect to solid materials.

The invention has among its objects the provision of a more efficient method of mineral flotation with a large-scale decrease of capital investment and a simultaneous increase of the feedstock base.

The objects of the invention are achieved by means of a flotation process with a pulsing air supply, wherein a high density pulp treated by flotation agents is fed to conventional flotation machines modified as described below, the necessary air being supplied by means of a pulsing air flow. Such air flow is provided by means of a controlling and metering member which is incorporated into the air supply pipeline of the machine.

The invention is practiced in froth flotation machines provided with a rotor-stator system as a basic aerating and agitating means, such machines having their own air-suction or being subaerational (with an air supply from an external high-pressure ventilator, etc.). The pulsed air supply in such type of machines represents the essence of the present invention.

With such machines:

When there is no air supply only the agitation of the material occurs, without any froth-removal from the surface of the floation machines, because the pulp-level therein appears lowered. The agitation in this period actually prepares conditions for the increased efficiency of flotation is the next air supply period; the cycle is repeated many times.

When there is an air supply, flotation is carried out with normal froth-removal on the pulp-surface.

With all types of flotation machines not provided with a rotor-stator system, which are therefore of a purely pneumatic or other type, the pulsing air supply leads to virtually the reverse results, i.e. when there is an air supply an agitation occurs, but when there is no air supply we observe a material-sedimentation, since there is no agitating member included.

According to the method of the present invention, the flotation machines remain open and the pressure upon the pulp surface always remains equal to atmospheric pressure. The method also avoids the use of air-dilution and its separation from the pulp, which is typical for dispersed air flotation and vacuum-type flotation. According to the invention the small change in the pressure of the line feeding air to the flotation machine aim at a change in the amount of air, but not an air dilution or the separation of said air from the solution, which however, can be achieved, but is not substantial for these pressure-changes.

The frequency and the time of pulsations of the air-supply according to the invention are so selected that the system relaxation time as whole always remains substantially shorter than the time of separate periods either with or without air-supply. This is an essential difference comparing to electroflotation, wherein the current pulses are supplied in order to depolarize and turbulize the bi-electrode layer: Electroflotation methods employ a much higher frequency and shorter time; the hydrodynamics of the system do not change as a whole due to viscous forces and to the minimal changes in pressure during the pulse supply period compared to that without a pulse air supply (the aeration ratio in electroflotation is substantially smaller than that with rotor-stator-system flotation machines).

The advantages of the invention are as follows: First the flotation machine of the invention can be operated with a pulp density which is up to 2 times above the normal, thus leading to an increased productivity of the flotation plant; second, there are an improved flotability of the larger paticles, a reduced consumption of flotation agents together with a reduced energy consumption per ton of treated ore, and the pulsed mode of air supply considerably improves the circulation of the solid phase in the machine.

In accordance with the invention the flotation ore pulp pretreated by known flotation agents and having a density up to twice the normal value, is submitted to flotation with the aid of a pulsed air flow, wherein periods of normal air supply alternate with periods of complete or partial air cutoff, i.e. with periods of air supply wherein the quantity of air alternates from 1 to 90% compared to the normal quantity of air. Each of the periods of normal air flow and complete or partial air cutoff may extend from 1 to 200 seconds.

When supplied, the air is submitted to dispersion by the rotor-stator system, thus obtaining a three-phase mixture. The air is indispensable for the flotation itself, but it impairs the dispersion of the solid materials with a consequent decrease of their content in the pulp.

At the moment of the air cutoff, the three-phase system is changed to a biphase one wherein the dispersion of solids is considerably improved. The hydrodynamics of the machine quickly changes and a normal circulation is thus effected notwithstanding the doubled density of the pulp.

Upon the renewal of the air supply, a certain part of the material starts to float due to the contact between the particles and the air bubbles. Without this condition, i.e. the pulsed air supply, the flotation at a pulp density above the conventional or normal value would be virtually impossible, since with a sufficient and constant quantity of air and at doubled ore pulp density, the flotation cells would be quickly filled with fallen-out material, due to an insufficient circulation. The pulsed air supply allows a full-scale flotation with a pulp density increase of 1.5–2 times compared to the normal density for the froth-type flotation or ores.

The apparatus according to the invention is based upon well-known froth flotation machines. In accordance with the invention, such machines are modified by the provision of a controlling member and of one or more air valves or the like incorporated into the air duct system of the machine. By means of such modification, an air supply in the form of a pulsed air flow of different frequency and duration of pulsations may be effected.

The illustrative embodiments of the invention are shown in the annexed drawings, wherein.

Figure 1:
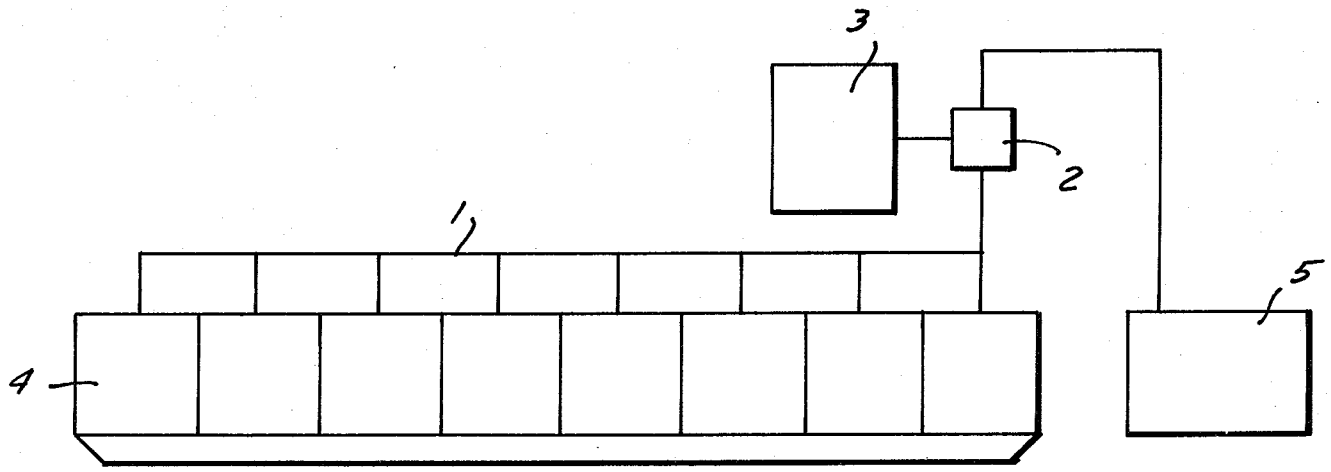
FIG. 1 is a diagram illustrating a first embodiment of the apparatus, such apparatus incorporating an external air supply.

Turning to FIG. 1, on the air duct 1 of an ore flotation machine having cells 4 there is mounted an air flow regulating and/or controlling member 2 receiving its command impulse from an adjusting command member 3. Air is supplied to air duct 1 by a compressor 5.

Figure 2:
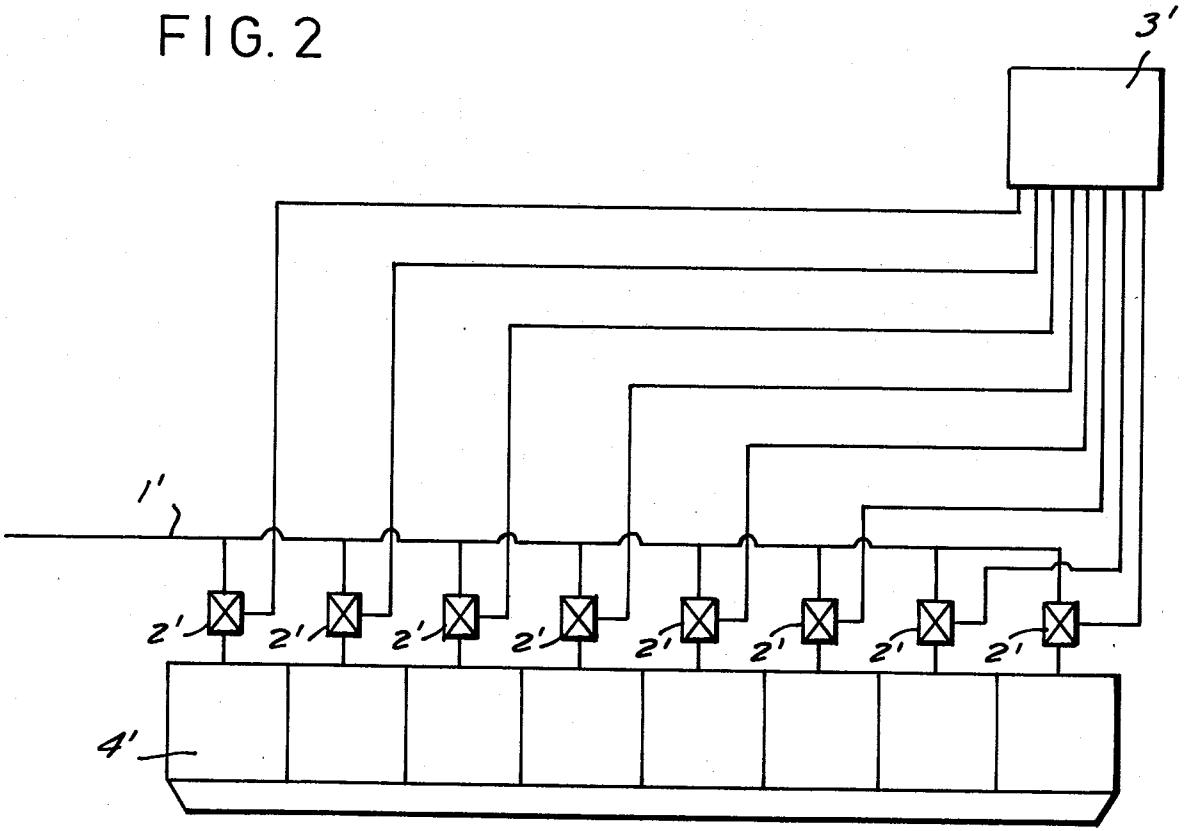
FIG. 2 is a diagram illustrating a second embodiment of the apparatus, such apparatus omitting the additional air supply.

In the embodiment of FIG. 2, air duct 1' of the cells 4' apply suction to the sealed cells 4' of the flotation machine. The pulsing of the suction of air applied to the cells 4' is effected by means of electromagnetic valves 2', which receive commands from a signal member 3'.

The method and apparatus of the invention have been employed successfully with feldspar-quartz feedstock to recover arseno-pyrite tin gravitational concentrates. It has been proven that with similar flotation times and similar techniques the pulp density in the machine of the invention is 1.5 to 2 times higher with 1.5 times lower consumption of flotation agents than with conventional machines. On the other hand, the concentrate comprises considerably larger particles than those obtained with normal froth flotation methods.

The experimental and technological results obtained by use of the method and apparatus of the present invention are shown in the following table:

TABLE

TEST RESULTS WITH A PULSING AIR SUPPLY
Test material: Feldspar, 1–0.063 mm particle size

| | | Starting material | | Concentrate | | | Waste | |
|---|---|---|---|---|---|---|---|---|
| Density gr/l | Type of test | Feldspar % | Yield % | Feldspar content-% | Extraction % | Yield % | Feldspar content-% | Extraction % |
| 585 gr/l | Lab. test | 24.00 | 25.27 | 92.00 | 96.89 | 74.73 | 1.00 | 3.11 |
| 585 gr/l | Lab. test | 30.75 | 29.26 | 93.00 | 88.48 | 70.74 | 5.00 | 11.52 |
| 617 gr/l | Lab. test | 29.06 | 30.83 | 92.00 | 97.61 | 69.17 | 1.00 | 2.39 |
| 667 gr/l | Lab. test | 31.05 | 31.09 | 91.00 | 91.12 | 68.91 | 4.00 | 8.88 |
| 500 gr/l | Semi-industrial test in 100 1-cell | 26.96 | 28.05 | 91.00 | 94.66 | 71.95 | 2.00 | 5.34 |
| 700 gr/l | Semi-industrial test in 100 1-cell | 27.36 | 25.41 | 96.00 | 89.10 | 74.59 | 4.00 | 10.90 |

Test material: Arseno-pyrite & tin gravitational concentrate 0.6–0 mm particle size

| | | Starting material | | | Concentrate | | | | | Waste | | | |
|---|---|---|---|---|---|---|---|---|---|---|---|---|---|
| Density | Type of test & | Content | | Yield | Content | | Extraction | | Yield | Content | | Extraction | |
| gr/l | conditions | As | Sn | % | As | Sn | As | Sn | % | As | Sn | As | Sn |
| 400 gr/l | Lab. test w/pulsing air supply | 27.20 | 11.98 | 63.49 | 41.80 | 0.24 | 96.84 | 3.27 | 36.51 | 2.37 | 32.40 | 3.16 | 98.70 |

A Comparative Test With Feldspar With Constant Air Supply

| Density gr/l | Type of test | Starting material % | Yield % | Concentrate content % | Extraction % | Yield % | Waste content % | Extraction % |
|---|---|---|---|---|---|---|---|---|
| 340 gr/l | Lab. test | 28.36 | 23.73 | 97.00 | 81.17 | 76.27 | 7.00 | 18.83 |

Figure 3:
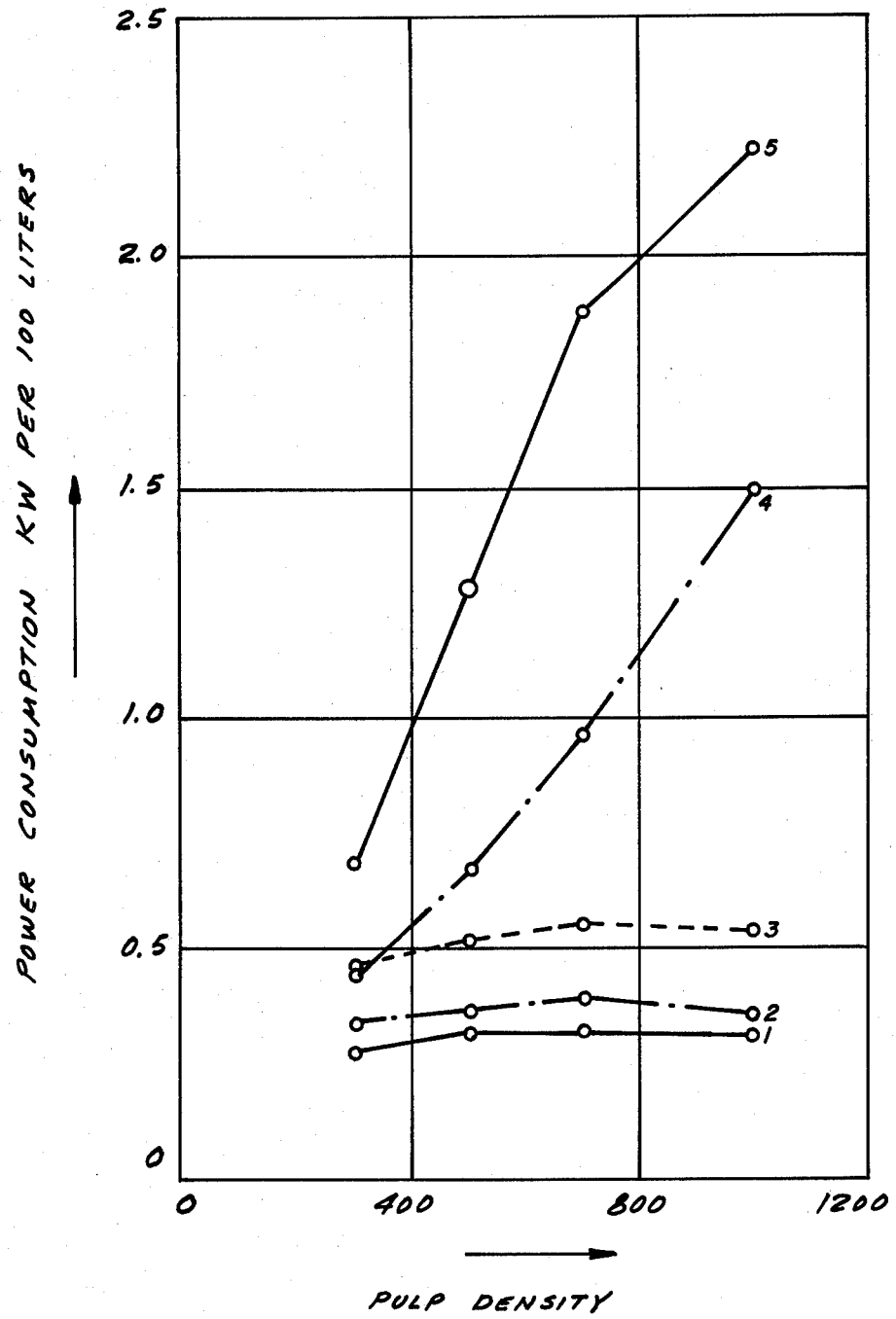
FIG. 3 is a graph illustrating the results obtained by use of the method of the invention.

In the graph of FIG. 3 pulp density is plotted along the abscissa and power consumption is plotted along the ordinate. Curves 1 and 2 show the relationship between pulp density and power consumed by driving the rotor when the apparatus is operated in accordance with the present invention, whereas curves 4 and 5 show the pulp density in relation to the power consumed by driving the rotor when the apparatus was operated in accordance with conventional flotation art. In curve 3 the rotor was rotated at almost constant speed which was sufficient for a good material dispersion, but no air was supplied to the flotation cell. In curve 5 air was supplied to the flotation chamber at a constant rate of 12,00 liters per hour. In curve 4, air was supplied to the flotation chamber at a constant rate of 6,000 liters per hour. In both cases (curves 5 and 4) the electrical power consumed increases with the increase of the pulp density, i.e. with the increase of the % of the solid in the pulp. When the air flow rate is greater (curve 5), more power is consumed i.e. a higher speed of the driving motor for the rotor is necessary for good material dispersion so that there is no material sedimented on the bottom of the flotation cell.

In the operation depicted in curves 1 and 2 pulsed air was delivered to the flotation chamber in accordance with the invention. In curve 1 the total flow rate of air in a one-hour period was 12,00 liters, the alternating periods of higher and lower flow rates of the air delivered to the flotation chamber being of equal duration, for example equal periods of time with air and without air. In curve 2 the total flow of air to the flotation chamber in a one-hour period was 6,000 liters, the duration of the alternating period of higher and lower flow rates of the air delivered to the flotation chamber being of equal duration, the same as in the curve 1.

Both curves 1 and 2 show lower electrical power consumptions by the motor compared with curves 4 and 5 with equal pulp densities.

It can be seen from curves 1 and 2 in FIG. 3 that the method and apparatus of the present invention markedly reduce the demand for power to the rotor in the flotation chamber, while attaining the same pulp densities as those achieved by use of prior art methods and apparatus. The method and apparatus of the invention have been also used successfully under conditions of semi-industrial experiments involving the purfication of quartz-carrying sands from sulfide and oxide-containing ferrous minerals. As indicated above, the method of ore flotation with pulsed air supply of the invention is applicable to machines with inherent air suction and also to ore flotation machines supplied with air from external compressed air sources.

With reference to the term "rotor-stator system" employed above, the rotor-stator systems, which are used in the practice of the present invention, have been known in the technical literature for about 50 years. As above noted, such system is also shown in the Green U.S. Pat. No. 3,882,016. They serve for the agitation of the pulp, as well as for suction and dispersion of the air in it, during which the flotation itself is carried out. Every system of this kind has a rotor, which agitates, and a stator around the rotor, which improves the air-dispersion and the dispension of the hard particles in the flotation machine. Flotation machines of this type are sold, for example, under the names "Denver", "Humboldt", "Adjeeter".

With the existing methods of flotation there are obtained about 400 gr/l of solids in the pulp. With the present method with pulsing air supply there can be obtained about 800 gr/l of solids in the pulp.

Although the invention is illustrated and described with reference to a plurality of preferred embodiments thereof, it is to be expressly understood that it is in no way limited by the disclosure of such a plurality of embodiments, but is capable of numerous modifications within the scope of the appended claims.

What is claimed is:

1. In a method of froth flotation of mineral raw materials, wherein the mineral raw materials are pretreated with at least one flotation agent and are subjected to treatment in an ore flotation machine with a rotor-stator apparatus provided with one or more cells which are always subjected to atmospheric pressure at the pulp level surface, the improvement which comprises alternately reducing and increasing the flow rate of the gas supplied for the flotation process in a plurality of the same repetitive cycles, the quantity of the gas supplied to the cells under the lower flow rate being from 1 to 90% of that supplied to the cells under the higher flow rate, and when the cells of the ore flotation machine are supplied with gas at the higher rate the cells contain a three-phase system composed of solid, liquid, and gas, and when the cells of the ore flotation machine are supplied with gas at the lower rate the cells contain a two-phase system composed of solid and liquid.

2. The method of claim 1, wherein each of the periods in which the gas flow rate is reduced and the periods in which the gas flow rate in the cells is higher ranges from 1 to 200 seconds.

3. The method according to claim 2, wherein the gas is air.

4. The method according to claim 3, wherein the flotation cells are periodically supplied with air by their own suction.

5. The method according to claim 3, wherein the flotation cells are periodically supplied with air from an external source of high-pressure air.

6. An apparatus for the treatment of mineral raw materials comprising an ore flotation machine with a rotor-stator apparatus provided with one or more cells, the improvement which comprises means for supplying the cells with a gas atmosphere, valve means, and means to control the valve means so as alternately to reduce and to increase the flow rate of the gas supplied to the cells in a plurality of the same repetitive cycles, the quantity of the gas supplied to the cells under the lower flow rate being from 1 to 90% of that supplied to the cells under the higher flow rate, the valve means supplying the cells of the ore flotation machine with gas at the higher rate so that the cells contain a three-phase system composed of solid, liquid, and gas, and the valve means supplying the cells of the ore flotation machine with gas at the lower rate so that the cells contain a two-phase system composed of solid and liquid.

7. The apparatus of claim 6, wherein each of the periods in which the gas flow rate is reduced and the periods in which the gas flow rate in the cells is higher ranges from 1 to 200 seconds.

8. The apparatus according to claim 7, wherein the gas is air.

9. The apparatus according to claim 8, wherein the flotation cells are periodically supplied with air by their own suction.

10. The apparatus according to claim 8, wherein the flotation cells are periodically supplied with air from an external source of high-pressure air.

* * * * *